US005518241A

United States Patent [19]

McHale

[11] Patent Number: 5,518,241

[45] Date of Patent: May 21, 1996

[54] REVERSE HOSEL IRON GOLF CLUB

[76] Inventor: Michael J. McHale, P.O. Box 4695, Calabash, N.C. 28467

[21] Appl. No.: 296,592

[22] Filed: Aug. 29, 1994

[51] Int. Cl.[6] ..... A63B 53/04

[52] U.S. Cl. ..... 473/349; 473/324

[58] Field of Search ..... 273/167 R, 167 A, 273/167 F, 167 G, 167 H, 169, 170, 171, 172, 173, 174, 78, 79, 77 R, 175, 167 J, 80 C

[56] References Cited

U.S. PATENT DOCUMENTS

| | | | |
|---|---|---|---|
| 1,525,148 | 2/1925 | Pickop | 273/167 G |
| 1,550,501 | 8/1925 | Byrne | 273/167 G |
| 1,674,487 | 11/1927 | Vernon | 273/175 |
| 1,993,928 | 3/1935 | Glover | 273/79 |
| 2,007,377 | 7/1935 | Link | 273/167 F |
| 2,683,036 | 7/1954 | Klein | 273/167 G |
| 4,995,609 | 2/1991 | Parente | 273/167 F |
| 5,183,255 | 2/1993 | Antonious | 273/167 G |

OTHER PUBLICATIONS

"Golf World" Magazine, Jan. 1973, p. 23.

*Primary Examiner*—Sebastiano Passaniti

[57] ABSTRACT

An iron golf club having a golf club head with a front face and a hosel connected to the front face extending through the club head is provided. The hosel extends into a knob area and backwardly to the front face. A club head is provided having a hosel section which is less than 15% of the total club head weight.

14 Claims, 2 Drawing Sheets

FIG. 1
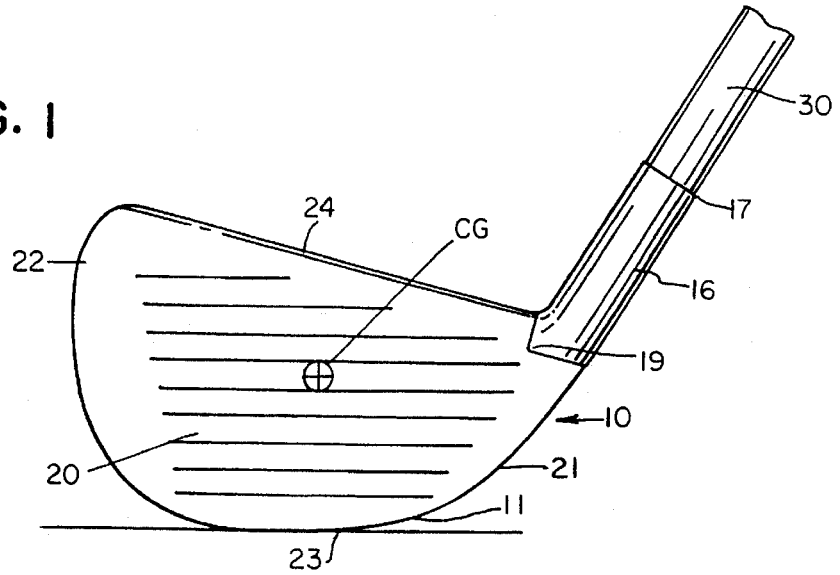
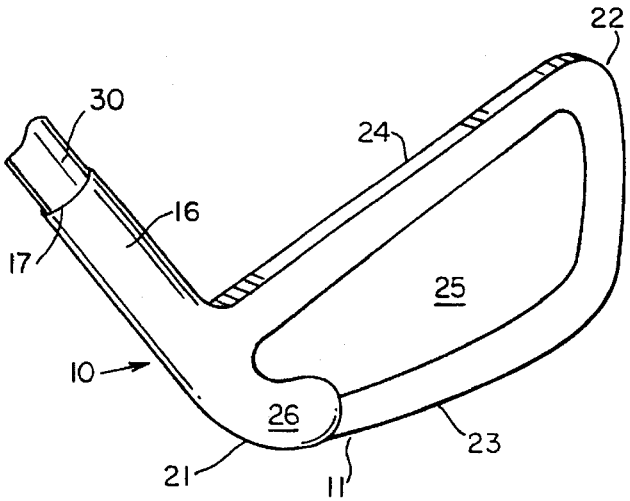
FIG. 2
FIG. 3
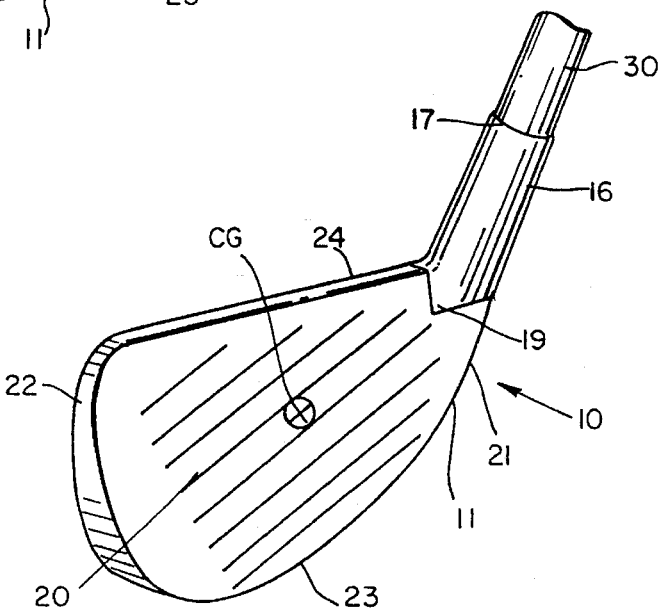

REVERSE HOSEL IRON GOLF CLUB

BACKGROUND OF THE INVENTION

The invention involves a golf club and in particular provides a golf club head for use on a fairway of a golf course or off the fairway in troublesome areas of the course.

Hitting a golf ball straighter and longer on a golf course is perhaps the most difficult challenge for every golfer. Since the origin of golf, inventors have attempted to invent golf clubs, irons or woods, which would hit the ball higher with more back spin and solve the problem of shanking, hooking, or slicing the ball. Unfortunately, most of the problems that underlie bad golf is the players ability to keep everything in position as the club travels through a swing plane. Hands turn, shoulders dip, legs stiffen, the head pops up, and the ball is headed for the woods. In order to overcome the many mistakes a golfer can make, golf clubs and golf heads have been bent and turned to compensate for the body movements during the swing.

Shank proof clubs such as those disclosed in the patents to Byrne U.S. Pat. No. 1,550,501, Koorland U.S. Pat. No. 3,539,184, and Saito U.S. Pat. No. 5,106,088 have failed commercially because the clubs took too much distance away from the flight of the ball in compensating for direction. Perhaps the most commercially successful shankproof iron is disclosed in U.S. Pat. No. 5,183,255 to Anthony J. Antonious. Antonious discloses a club head having an improved hosel construction wherein the hosel is positioed behind the ball striking face adjacent the heel. Moreover, the centerline of the hosel intersects with the extended plane of the ball striking face at a point proximate the club head's center of gravity and above the lower quadrant of the club head. Although some shank proof clubs have had commercial success, there remains a need for a club, despite a player's movements, which will provide direct flight for a ball with plenty of distance, and improve shots from any lie.

SUMMARY OF THE INVENTION

It is an object of this invention to provide a golf club having a golf club head with a front face, a hosel connected to the front face, extending through the club head, to a heel portion of said club head, into a knob area, and then backwardly toward said front face. The hosel centerline is positioned behind the clubface and just rearward of the clubhead's longitudinal center of gravity, creating a golf club with positive face progression.

It is a further object of the invention to provide a club head having a knob area located in said heel portion of said head in order to provide a weight behind the clubface at the bottom of said hosel.

It is an additional object of this invention to provide a club head having a twisting hosel which enters the head at the front face and turns back to the front face area after extending near the heel.

It is a specific object of the present invention to provide a golf club for hitting a golf ball higher and straighter with more back spin.

It is an object of this invention to provide a golf club head for use in any situation encountered on any golf course.

It is an object of this invention to provide a golf club head wherein the hosel section of said club head constitutes less than 15% of the total club head weight.

It is a further object of the present invention to provide a golf club having a hook shaped hosel that enters the front face of the golf head and turns inside the head and ends facing the front face of the club head.

The present invention provides a golf club having a golf club head that prevents hooking, shanking, and slicing by removing a substantial amount of weight from the toe of the head, and adding the weight directly behind the hosel while connecting the hosel to the front face of the club extending the hosel to the rear heel area of the club and then hooking the hosel toward the front face. The added weight directly behind the clubface at the hosel/heel gives the player a pushing effect swing. The hosel entering the front face of the club and positioning the face in front of the shaft centerline produces higher and straighter golf shots. The advantage of such a set up is more clubhead speed, less clubhead torquing in the speed zone, and less clubhead knockback at ball impact, resulting in longer and straighter golf shots. Refer to "The Golfing Machine" by Homer Kelley, Chapters 2A Resilience and 2B Trajectory Control. Also refer to "Golf Club Design, Fitting, Alteration, and Repair" by Ralph Maltby, Chapters 44–47.

The hosel is somewhat reversed in the present invention. The shaft tip centerline at the bottom of the hosel bore is parallel to and just rearward of the clubhead's longitudinal center of gravity. A mechanical advantage is gained with this hosel by setting up a pushing action on the clubhead-shaft-hands-radial that delays the in-line effect of centrifugal acceleration until just before inpact, i.e. making the clubhead acceleration an overtaking process. Refer to "The Golfing Machine" by Homer Kelley, 1. Force Vectors, Chapter 2C0, Linear Force; 2. Impact Physics, Chapter 2E, Conservation of Momentum; 3. Law of the Flail, Chapter 2K, Generation of Angular Motion; 4. The Lever, Chapter 2L, Application of Force; 5. Potential and Kinetic Energy, Chapter 2M1, Basic Power. In tests using a SPORTTECH SWING ANALYZER (computerized speed measuring equipment), the reverse hosel increased clubhead speed in m.p.h. up to 5–10% more than a conventional club of similar construction. A counter balancing weight bar, strategically located for each club in the set, is placed in the rear cavity behind the clubface to offset the heel mass. The toe weight bar allows the clubhead to close easier during the centrifugal effects of the downswing. The hosel retards clubhead torqueing in the downswing speed zone and at impact allowing the original contact points of the clubface and ball to remain in contact throughout the entire impact interval. The reversed hosel and strategically placed weighting bar resists clubhead knockback at ball impact, resulting in a faster ball and clubface separation speeds. The combination effects of the present invention result in longer and straighter golf shots.

DESCRIPTION OF THE DRAWINGS

FIG. 1 shows a front elevational view of the golf club head of the present invention.

FIG. 2 shows a rear elevational veiw thereof.

FIG. 3 shows a front perspective view thereof.

DESCRIPTION OF THE PREFERRED EMBODIMENTS

Figure 4:
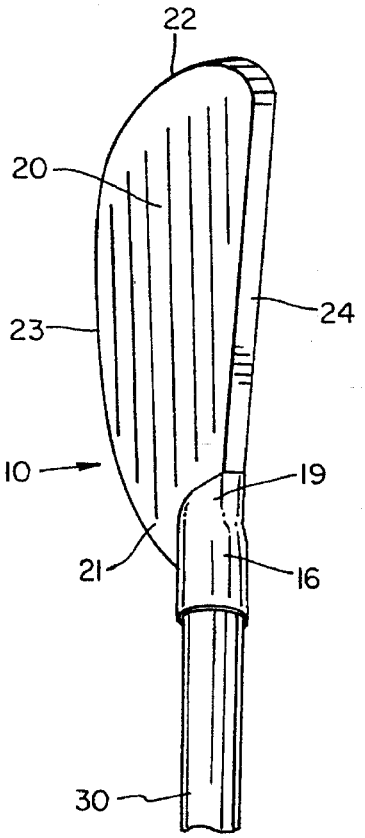
FIG. 4 shows a top plan view thereof.

Referring now to FIG. 1, the present invention comprises a golf club having a head (10), a club face (20), a sole portion (11) and a hosel portion (16) connected to the head by a web (19) and extending upwardly to receive a shaft (30). The hosel has an upper end (17) with a socket for connecting the shaft to the hosel and the club head. Although right handed clubs are shown in the drawings and described in the description herein, the concepts disclosed apply equally to left handed clubs, the relative positioning and location of elements and portions thereof simply reversed from that which is shown therein. The clubs, as shown and described herein, are of the iron type for use in the fairway of a golf course, as opposed to putters for use on the greens.

More particularly, the present invention relates to iron type golf club heads having positive face progression wherein the leading edge of the club face is formed in front of or forward of the centerline of the hosel. Most iron type golf club heads are constructed with negative face progression, wherein the leading edge of the clubface is behind the centerline of the hosel, creating an offset. These offset clubs are ineffective in that the hosel and the bridge member between the hosel and the ball striking face extend forward of the ball striking face. Not only does this design create the possibility of hitting a "shanked shot" but gives the user a false confidence that the club face will reach the ball no matter the lie. The problem created is one of hitting on top of the ball. The result is overswinging, resulting in a shanked, sliced, or hooked shot.

Referring back to FIG. 1, a web (19) is integrally formed onto the club face. Accordingly, the hosel enters the club face of the head at an angle approximately 30° relative to the vertical plane of the club face. The web (19), a portion of the lower end of the hosel, is formed like a glove onto the club face surface. While the web extends the hosel onto the club face the remaining lower end of the hosel enters the club head unlike a traditional iron hosel. The web (19) formed into the club face of the head at an angle of approximately 30 ° relative to the vertical plane of the club face reduces the possibility of topping the ball and shanking problems.

Referring now to FIGS. 1–7, the golf club head of the present invention further includes a heel (21), a toe (22), a sole (23), and a top ledge (24). The club face (10) has a center of gravity (CG). The hosel (16) includes a centerline (31) shown only in FIGS. 6 and 7 extending along the longitudinal axis thereof.

Returning now to FIG. 2 the club head (10) is shown with a rear view illustration of the hosel (16) and sole (23). As illustrated in FIG. 2 the head (10) includes a cavity back (25) which hosel (16) meets integrally. The hosel enters the top ledge (24) and the cavity back (25) such that the hosel axis is substantially behind the sole of the club but substantially in front of the top ledge of the club. (See FIGS. 6 and 7). The hosel includes a knob (26) positioned off line of the hosel axis. The knob, or weighted area, is selectively positioned on the back and bottom hosel area on the opposite side of the club face of the web (19). The cavity back (25) could also be provided with a counter weight in the center of the back area if necessary. The concept of providing the web and knob on opposite sides of the club head bring the structure of the hosel to form a hook through the club head.

Figure 5:
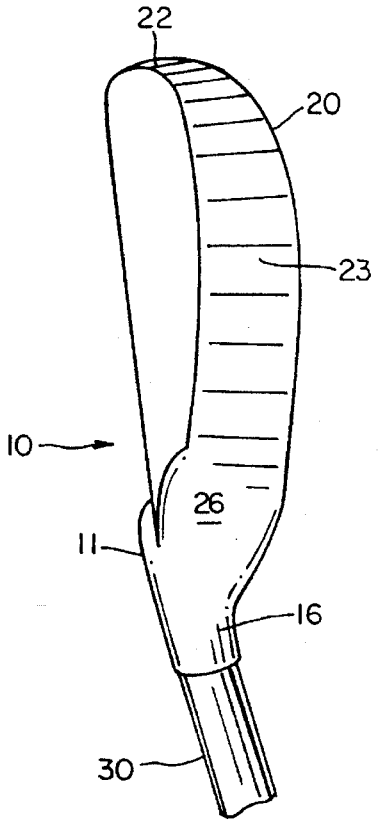
FIG. 5 shows a bottom plan view thereof.
Figure 6:
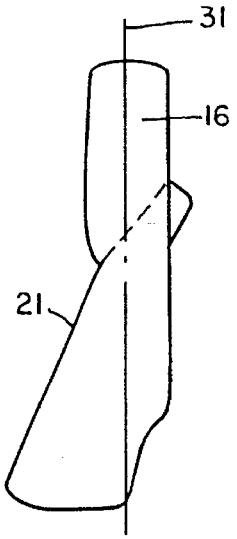
FIG. 6 shows an end elevational view thereof.
Figure 7:
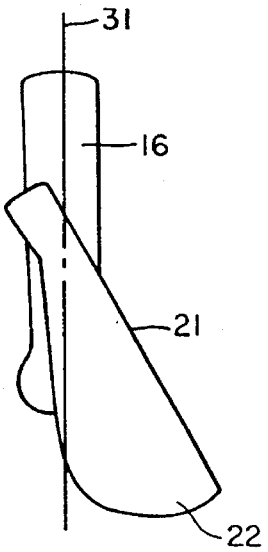
FIG. 7 shows a rear elevational view thereof.

A top plan view of the present invention is illustrated in FIG. 4 and a bottom plan view is illustrated in FIG. 5. FIG. 4 clearly illustrates the web reaching over onto the club face. FIG. 5 shows the hosel coming through to form the knob.

Turning once again to FIG. 6, the club head is shown by illustrating an end view of the head taken on the hosel end of the club head. The hook shaped hosel places the shaft centerline behind the ball striking club face. Positioning of the club face in front of the shaft centerline sets up a pushing action on the clubhead-shaft-hands radial and delays the "in line" effect of centrifugal acceleration until just before impact. By contrast, a conventional hosel with negative face progression sets up a pulling action on the clubhead-shaft-hands radial and delays the "in line" effect of centrifugal acceleration until well past impact. The net effect of clubs of similar construction are that a club with a positive face progression will outperform a club with negative face progression by approximately 5–10%.

Typically, 20–25% of a clubhead's total weight is positioned at the heel to accommodate the shaft. An average conventional progressive offset #5 iron of 256 grams, the hosel section will weigh approximately 55 to 64 grams. With the present invention, the hosel has been shortened and moved higher on the clubface and closer to the clubhead's center of gravity, in effect reversing it, giving the hosel a rearward curve. The present invention with a hook shaped hosel constitutes less than 15% of the total clubhead weight. The 30 grams of weight saved can be redistributed as increased mass to the clubhead's main body in the form of perimeter weighting to the cavity back (25), and/or to increase the sole weight (23), and/or behind the hosel (16) in the form of a knob to help decrease clubhead torquing and clubhead knockback at ball impact. With 30 grams of weight removed from the hosel section, the reverse hosel is still a stronger shaft connection point than a conventional progressive offset iron. The reverse hosel is shorter in length and located higher on the clubface and closer to the clubhead center of gravity. The hosel centerline is set up behind the clubface and aligned with the clubhead's trailing edge. Also a majority of remaining hosel weight is positioned in the lower heel area behind the clubface and below the clubhead's center of gravity. This combination of redistributing the 30 grams or more of weight to the main clubhead body and/or the hosel location, retaining the hosel strength, produces a higher moment of inertia.

It will be apparent to those skilled in the art that various modifications and variations can be made in the golf head of the present invention and in construction of this golf club head without departing from the spirit of the invention.

What is claimed:

1. A golf club head for an iron type golf club comprising:

a golf head portion having a front face, a sole, a toe, and a heel portion;

said front face extending from said toe to said heel portion and having a top ledge;

a hosel, said hosel having a web, said web entering said front face below said top ledge and at an angle relative to the plane of said front face adjacent a front of said heel portion, said heel portion having an outwardly extending knob portion lying in the same horizontal plane as said web of said hosel;

said knob portion being located substantially opposite said web adjacent a back of said heel portion.

2. The golf club head of claim 1, said angle at least 30° relative to said front face.

3. The golf club head of claim 1, said knob portion including a weighted mass.

4. The golf club head of claim 1, said hosel constituting less than 15% of the total club head weight.

5. A golf club for striking a golf ball comprising:

a shaft, a hosel, a golf head having a golf head portion, said shaft, said hosel, and said golf head portion connected to form a golf club;

said golf head portion having a front face, a sole, a toe, and a heel portion;

said front face extending from said toe to said heel portion and having a top ledge;

said hosel having a web, said web entering said front face below said top ledge and at an angle relative to the plane of said front face adjacent a front of said heel portion, said heel portion having an outwardly extending knob portion lying in the same horizontal plane as said web of said hosel;

said knob portion being located substantially opposite said web adjacent a back of said heel portion.

6. The golf club of claim 5, said angle at least 30° relative to said front face.

7. The golf club of claim 5, said knob portion including a weighted mass.

8. The golf club head of claim 5, said hosel constituting less than 15% of the total club head weight.

9. The golf club of claim 5, said hosel entering said front face of said head portion and extending through said head portion to said heel portion and turning back forwardly to said face portion.

10. A golf club head for striking a golf ball, said head including:

a golf head portion having a front face, a sole, a toe, and a heel portion;

said front face extending from said toe to said heel portion and having a top ledge;

said hosel having a web, said web entering said front face below said top ledge and at an angle relative to the plane of said front face adjacent a front of said heel portion, said heel portion having an outwardly extending knob portion lying in the same horizontal plane as said web of said hosel, said knob portion having a flattened back area;

said knob portion being located substantially opposite said web adjacent a back of said heel portion.

11. The golf club head of claim 10, said angle at least 30° relative to said front face.

12. The golf club head of claim 10, said knob portion including a weighted mass.

13. The golf club head of claim 10, said hosel constituting less than 15% of the total club head weight.

14. The golf club head of claim 10, said hosel entering said front face of said head portion and extending through said head portion to said heel portion and turning back forwardly to said face portion.

* * * * *